US006497499B1

(12) United States Patent
Fischer et al.

(10) Patent No.: US 6,497,499 B1
(45) **Date of Patent: *Dec. 24, 2002**

(54) LUMINAIRE

(75) Inventors: Jerry F. Fischer, West Chester; William R. Wedding, Cincinnati; Michael D. Wyatt, Hamilton, all of OH (US)

(73) Assignee: LSI Industries Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/121,490

(22) Filed: Jul. 23, 1998

Related U.S. Application Data

(63) Continuation-in-part of application No. 08/890,118, filed on Jul. 9, 1997, now Pat. No. 6,059,422, which is a continuation of application No. 08/532,901, filed on Sep. 22, 1995, now Pat. No. 5,662,407.

(51) Int. Cl.[7] ..... F21K 27/00

(52) U.S. Cl. ..... 362/265; 362/147; 362/365; 362/374

(58) Field of Search ..... 362/147, 148, 362/150, 152, 102, 365, 265, 267, 457, 374, 370

(56) References Cited

U.S. PATENT DOCUMENTS

| | | | |
|---|---|---|---|
| 1,248,187 | A | 11/1917 | Smith |
| 1,291,701 | A | 1/1919 | Adam |
| 1,678,137 | A | 7/1928 | Douglas |
| 1,732,407 | A | 10/1929 | Kelsea |

(List continued on next page.)

FOREIGN PATENT DOCUMENTS

| | | |
|---|---|---|
| GB | 7125757 | 8/1952 |
| GB | 837214 | 11/1956 |

OTHER PUBLICATIONS

Devine Lighting, *System Ten DLS*, Brochure, 8 pgs., 1987.

Devine Lighting, *Garage Fixture Series GFO*, Brochure and Drawings, 5 pgs., (1986, 1987).

Devine Lighting, *Garage/Area Series 80*, Brochure, 8 pgs., 1989.

McPhilben, *Mercury Vapor Incandescent or Quartz–halogen Recessed or Semi–Recessed Downlights*, Brochure, undated.

Devine Lighting, *Semi–Recessed Round*, Brochure, 1986.

Venture Lighting International, Inc., *Product Specification Bulletin*, undated.

STAFF Lighting Corp, *Adjustable Downlight*, Specification, 1980.

Miller Lighting, *Lightwatt Assembly*, Two Drawings Numbered 102937, Oct. 1981.

The Miller Company, *Semi–Recessed Light Watt*, Brochure, 6 pages., 1987.

Devine Lighting, *Garage Lighting*, Brochure, 4 pgs., 1987.

Devine Lighting, *Specification Features*, 5 pgs., Nov. 1986.

Teron Lighting Inc., *Teron Series*, brochure, 15 pages.

Lithonia Lighting, *High–Abuse Lighting*, Brochure, 1996 (3pgs.).

lithonia Lighting *Product Selection Guide, Edition 2*, Brochure, 1991, rec. Feb. /93 (4pgs.).

Web Page, Lithonia Lighting, (Jul. 1999).

*Primary Examiner*—Sandra O'Shea
*Assistant Examiner*—Ali Alavi
(74) *Attorney, Agent, or Firm*—Wood, Herron & Evans, L.L.P.

(57) ABSTRACT

The present invention provides a luminaire component housing which has at least two upwardly opening pockets substantially equal to the heights of the components to be fitted therein. The component housing has a cover which cinches the components into their respective pockets, thereby eliminating the need for metal straps, screws or other traditional hardware to secure components into place.

15 Claims, 3 Drawing Sheets

U.S. PATENT DOCUMENTS

| | | | | | |
|---|---|---|---|---|---|
| 1,918,031 | A | | 7/1933 | Goldner | |
| 1,931,343 | A | | 10/1933 | Cook et al. | 240/78 |
| 2,225,057 | A | | 12/1940 | Kuntz | 240/2 |
| 2,288,941 | A | | 7/1942 | Curtis | 240/78 |
| 2,305,723 | A | | 12/1942 | Livers | 240/81 |
| 2,313,131 | A | | 3/1943 | Ilias | 240/78 |
| 2,406,104 | A | | 8/1946 | Ranney | 315/84 |
| 2,675,466 | A | | 4/1954 | Baker | 240/78 |
| 2,700,751 | A | | 1/1955 | Hallerberg | 339/128 |
| 2,712,120 | A | | 6/1955 | Cochran | 339/128 |
| 2,826,684 | A | | 3/1958 | Baker | 240/78 |
| 2,833,916 | A | | 5/1958 | Foulds | 240/25 |
| 2,849,574 | A | | 8/1958 | Burns et al. | 200/118 |
| 2,916,609 | A | | 12/1959 | Barchmann et al. | 240/25 |
| 3,096,029 | A | | 7/1963 | Berge | 240/25 |
| 3,123,310 | A | | 3/1964 | Dameral | 240/51.11 |
| 3,176,255 | A | | 3/1965 | Jenson | 339/17 |
| 3,387,255 | A | | 6/1968 | Earleywine, Jr. | 339/188 |
| 3,431,003 | A | | 3/1969 | Bacon, Jr. et al. | 292/256 |
| 3,511,982 | A | | 5/1970 | Salter | 240/8.16 |
| 2,225,217 | A | | 12/1970 | Hicok | 240/7.35 |
| 3,860,829 | A | | 1/1975 | Fabbri | 307/66 |
| 4,071,749 | A | | 1/1978 | Balogh | 362/20 |
| 4,186,433 | A | | 1/1980 | Baldwin | 362/263 |
| 4,250,540 | A | | 2/1981 | Kristofik | 361/368 |
| 4,275,433 | A | | 6/1981 | Caldwell | 362/22 |
| 4,315,302 | A | | 2/1982 | Petralia | 362/226 |
| 4,323,954 | A | | 4/1982 | Florence et al. | 362/267 |
| 4,326,243 | A | | 4/1982 | Pistor et al. | 362/368 |
| 4,330,814 | A | | 5/1982 | Baldwin et al. | 362/267 |
| 4,384,316 | A | | 5/1983 | de Vos et al. | 362/147 |
| 4,419,719 | A | | 12/1983 | Boer et al. | 362/218 |
| 4,420,798 | A | | 12/1983 | Herst et al. | 362/147 |
| 4,437,142 | A | | 3/1984 | Donato et al. | 362/226 |
| 4,459,648 | A | | 7/1984 | Ullman | 362/307 |
| 4,460,948 | A | | 7/1984 | Malola | 362/396 |
| 4,462,068 | A | | 7/1984 | Shadwick | 362/332 |
| 4,516,196 | A | | 5/1985 | Blake | 362/311 |
| 4,547,840 | A | | 10/1985 | Tinder | 362/226 |
| 4,563,729 | A | | 1/1986 | Jendrewski | 362/218 |
| 4,654,768 | A | | 3/1987 | Dryman et al. | 362/374 |
| 4,703,406 | A | | 10/1987 | Elliott et al. | 362/365 |
| 4,739,160 | A | | 4/1988 | Kelsall | 362/365 |
| 4,739,460 | A | | 4/1988 | Kelsall | 362/365 |
| 4,760,510 | A | | 7/1988 | Lahti | 362/365 |
| 4,763,231 | A | | 8/1988 | Houplain | 362/148 |
| 4,827,386 | A | * | 5/1989 | Mackiewcs | 362/267 |
| 5,045,984 | A | | 9/1991 | Trowbridge et al. | 362/365 |
| 5,068,772 | A | | 11/1991 | Shapiro et al. | 362/365 |
| 5,122,944 | A | | 6/1992 | Webb | 362/365 |
| 5,126,510 | A | | 6/1992 | Bauer et al. | 174/52.1 |
| 5,130,912 | A | * | 7/1992 | Friederichs et al. | 362/263 |
| 5,174,642 | A | | 12/1992 | Brohard et al. | 362/20 |
| 5,183,327 | A | | 2/1993 | Fabbri | 362/219 |
| 5,222,800 | A | | 6/1993 | Chan et al. | 362/147 |
| 5,228,773 | A | | 7/1993 | Win | 362/339 |
| 5,394,316 | A | | 2/1995 | Holbrook et al. | 362/294 |
| 5,440,471 | A | | 8/1995 | Zadeh | 362/365 |
| 5,463,540 | A | | 10/1995 | Jones | 362/260 |
| 5,465,199 | A | | 11/1995 | Stauber | 270/53 |
| 5,548,499 | A | | 8/1996 | Zadeh | 362/366 |
| 5,560,707 | A | | 10/1996 | Neer | 362/376 |
| 5,562,341 | A | | 10/1996 | Strauss | 362/226 |
| 5,567,041 | A | | 10/1996 | Slocum | 362/148 |
| D375,379 | S | | 11/1996 | DiCola et al. | D26/85 |
| 5,574,600 | A | | 11/1996 | Agro | 359/818 |
| 5,597,233 | A | | 1/1997 | Lau | 362/294 |
| 5,662,407 | A | | 9/1997 | Fischer et al. | 362/147 |
| 5,927,843 | A | | 7/1999 | Haugaard et al. | 362/147 |
| 6,059,422 | A | | 5/2000 | Fischer et al. | 362/147 |
| 6,116,749 | A | * | 9/2000 | Quiogue et al. | 362/148 |
| 6,224,233 | B1 | | 5/2001 | Fischer et al. | 362/147 |

* cited by examiner

LUMINAIRE

This application is a continuation-in-part of U.S. patent Ser. No. 08/890,118 filed Jul. 9, 1997 now U.S. Pat. No. 6,059,422 which issued on May 9, 2000, which is a continuation of Ser. No. 08/532,901 filed Sep. 22, 1995, now U.S. Pat. No. 5,662,407 which issued on Sep. 2, 1997.

FIELD OF THE INVENTION

This invention relates to luminaires. More particularly, this invention relates to a luminaire housing in which a luminaire's control components are enclosed and held in place without using securing hardware.

BACKGROUND OF THE INVENTION

Luminaires that include housings for lighting control components are known in the prior art. One type of luminaire utilizes a high intensity discharge ("HID") light source that is regulated by control components which may include a transformer alone or in combination with other components such as capacitors, ignitors, or other such equipment. These control components may be mounted within the luminaire's housing, or separate from the luminaire in a dedicated housing. For outdoor use, the control components are usually fitted inside a weatherproof enclosure, and for indoor use, the control components are often enclosed in the housing for safety purposes. If not integral within the luminaire's housing itself, the control components may sit outboard of the luminaire, attached to, nearby or remote from the luminaire which they control.

Traditionally, a luminaire's control components have been secured within their housing by screws, rivets, or other fasteners in combination with flanges or clamps integral with the components, and/or metal straps cinched around the components and affixed to the housing with screws. These traditional approaches are simple and worry free until a component needs to be replaced. Malfunctioned control components must be removed from their securing hardware within their housing, and new components must be inserted, often requiring new hardware to secure them properly, in order to prolong the useful life of the housing.

In the time consuming task of fitting a new control component with new hardware in an old luminaire that is still in use, one type of traditional luminaire makes use of a separate housing to enclose each separate component. This poses its own set of problems when a user is forced to repair the light. In this luminaire configuration, unless, without opening each component's housing, one can determine exactly which component has malfunctioned, the repair time to perform the job of replacing a single burned out component will be increased by time wasted exploring each separate component housing to find the problem.

Another type of traditional luminaire known in the art uses a single housing for multiple components. This type of housing usually has a constant height throughout its interior. In this approach, each of the control components is secured with traditional screws and metal straps to the housing's interior surface.

SUMMARY OF THE INVENTION

It is an objective of the present invention to provide a luminaire with a housing which is contoured to suit the heights of the control components fitted therein, that housing having at least two upwardly opening pockets whose heights are substantially equal to the heights of the control components positioned therein in combination with a cover which cinches the components into their respective pockets, thereby eliminating the need for metal straps, screws, or other hardware to secure components into place.

It is a further objective of the present invention to eliminate all unnecessary component securing fasteners, thereby reducing the manufacturing time and lowering the cost of the luminaire.

These and other objectives of the invention are achieved by providing a luminaire comprised of an upper housing which includes at least two upwardly opening control component pockets. In the preferred embodiment of the invention, a lower housing has an upwardly extending lamp socket which fits into a recess in the upper housing. The lower housing encloses the luminaire's lamp. The lower and upper housings are aligned so that the upper housing and the lower housing cinch together with an adjustable fastener, e.g., a bolt and nut assembly. This allows the upper and lower housings to sandwich between them a canopy to which the luminaire is mounted with the lower housing extending beneath that canopy to provide light beneath the canopy.

The upper housing has a cover which is secured to the upper housing's base. The cover cinches traditional metal control components into their respective pockets, thus eliminating the need for internal hardware to fasten the components into place. Traditional luminaire control components for HID light sources, such as ballasts and transformers having exposed wire coil windings or oval metal-can oil-filled capacitors with wiring terminals, are required by electrical codes to be secured in place with maintained spacings between these electrical parts. The present invention specifically addresses and solves the code requirements for these traditional control components. By cinching these control components into their respective pockets with an easily removable housing cover, the need for further securing hardware is eliminated, thereby reducing costs of manufacturing as well as the cost of maintenance and hardware needed to service malfunctioned luminaires.

Newer luminaire control components for HID light sources that do not need to be clamped in place, but only contained in a housing, also may be used in conjunction with the present invention. Control components such as cylindrical plastic dry-film capacitors or ignitors may not have spacing requirements like their traditional metal counterparts. The height of the plural pockets in the present invention are tailored to specifically suit the larger metal ballasts, capacitors and ignitors, but since the more modern plastic control components are smaller and are only required to be captured in a component housing, they also may be retained, though not clamped tightly, in the housing cavities without the use of screws, straps or other hardware fittings.

Other advantages of the invention will become more apparent to those of ordinary skill upon review of the following detailed description of the preferred embodiment taken in conjunction with the accompanying drawings.

DETAILED DESCRIPTION OF THE PREFERRED EMBODIMENT

Figure 1:
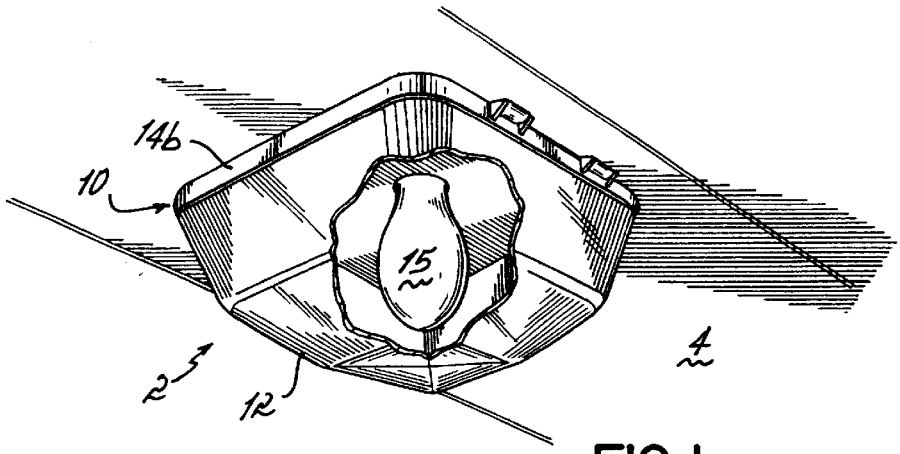
FIG. 1 is a perspective view of a luminaire in accord with the principles of this invention, the luminaire being mounted to a canopy.
Figure 4:
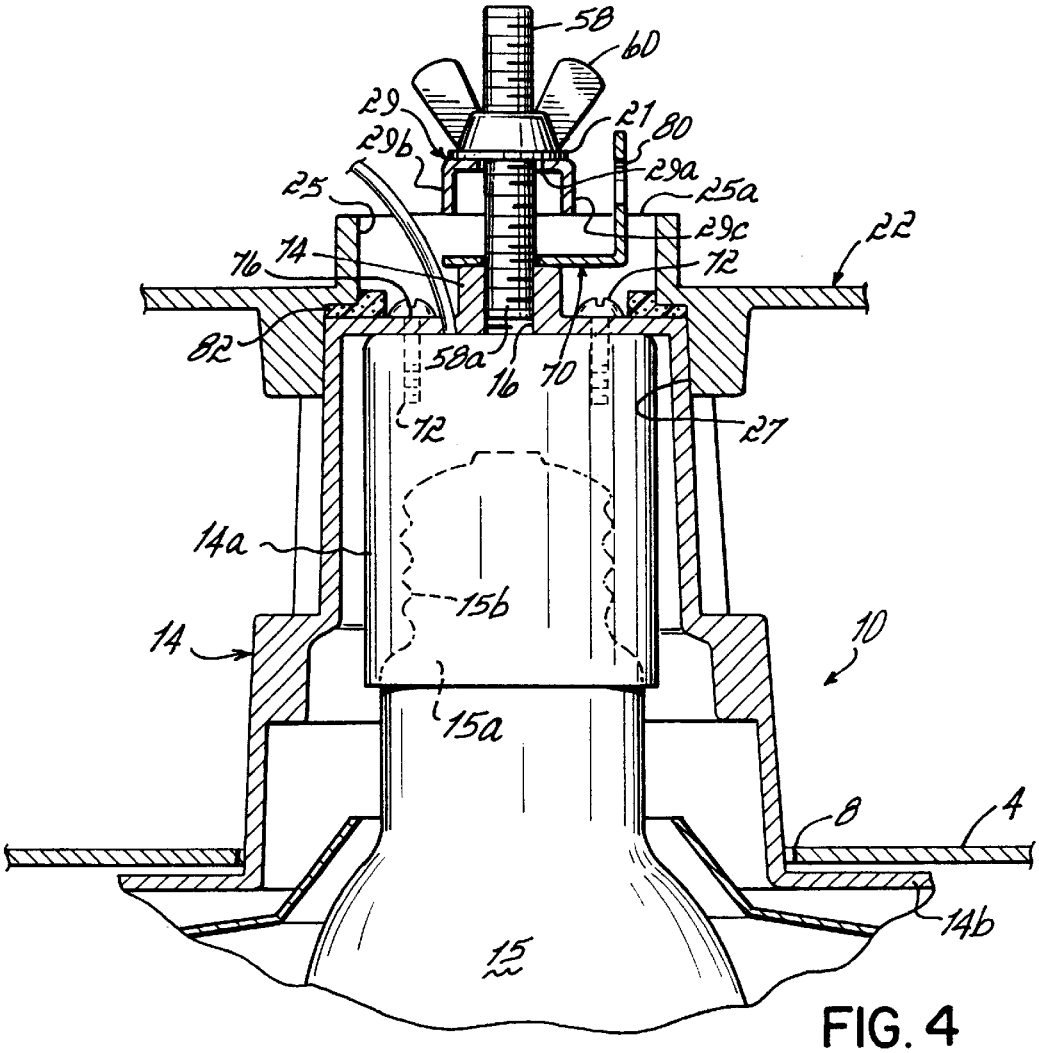
FIG. 4 is a cross-sectional view taken on line 4—4 of FIG. 2 of the lamp socket housing received in the upper housing's base.
Figure 2:
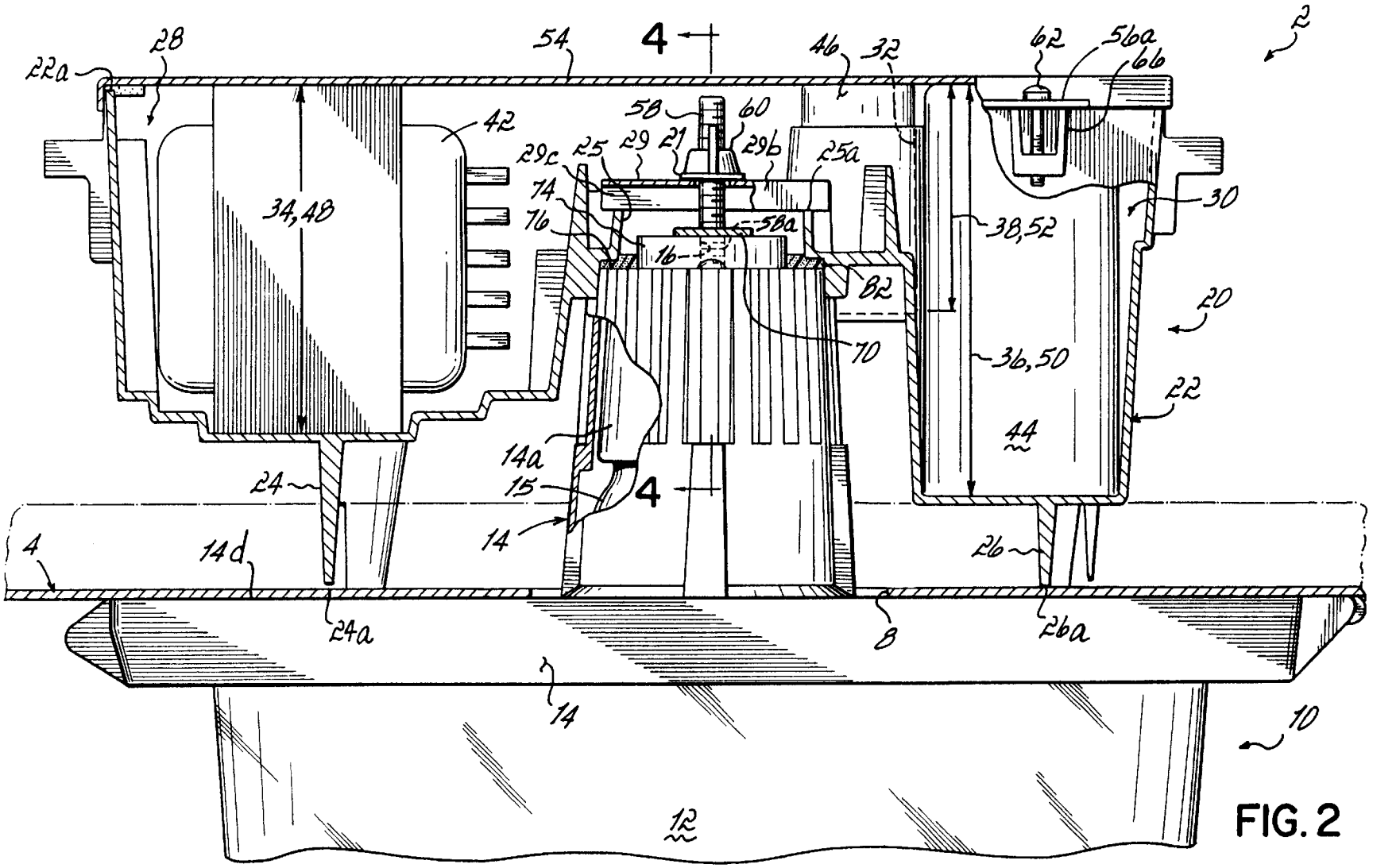
FIG. 2 is a side view partially broken away of a canopy cinched between the luminaire's upper housing with control components secured therein and lower housing.

Referring first to FIG. 1, a lower housing 10 of a luminaire 2 descends from a canopy 4. The luminaire 2 is of the type seen in U.S. Pat. No. 5,662,407. The lower housing 10 includes a socket housing 14 having a base 14*b* and a lens frame 14*c* to which a lens 12 is attached in any desired manner, (as seen in FIGS. 2 and 4), such as described in U.S. Pat. 5,662,407, owned by the assignee of the present application. The disclosure of U.S. Pat. 5,662,407 is incorporated herein in its entirety by reference. The socket housing 14 contains a socket 14*a*. A lamp 15 having a lamp base 15*a* threadedly received in socket 14*a*, extends downwardly into the interior of the lens 12. The socket housing 14 is received through an opening 8 defined in the canopy 4, as seen in FIGS. 3 and 4.

Figure 3:
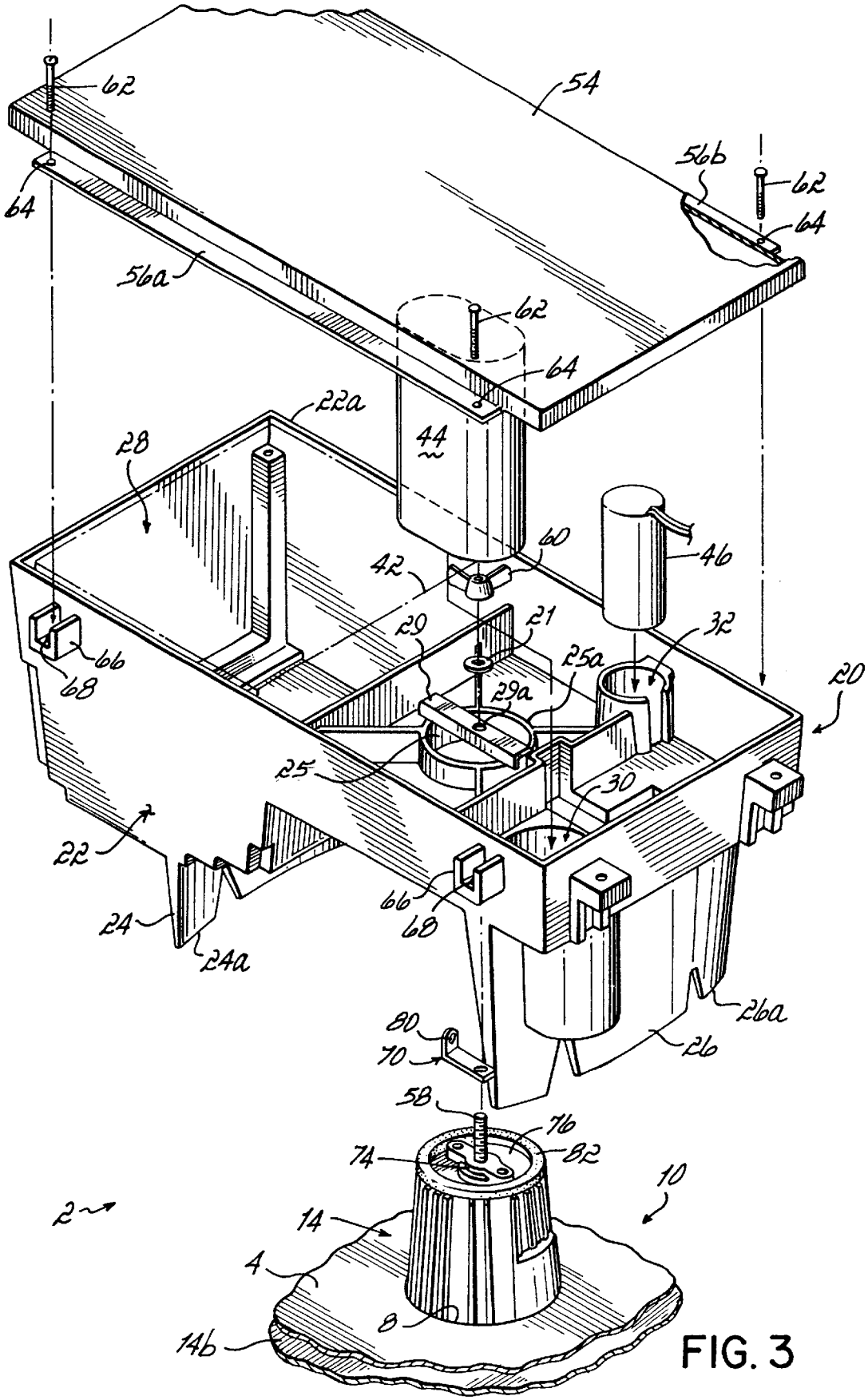
FIG. 3 is a perspective view of the luminaire's upper housing base disassembled from the upper housing cover in combination with the lower housing's lamp socket housing.

The luminaire 2 has an upper housing 20, as seen in FIGS. 2 and 3. The upper housing 20 has a base 22 which defines three upwardly opening pockets 28, 30, and 32. As seen in FIG. 2, pockets 28, 30, 32 have respective first, second and third heights 5 34, 36, 38. Luminaire components 42, 44, 46, such as a transformer (schematically depicted in phantom lines in FIG. 3), a capacitor, and an ignitor, respectively, have respective heights 48, 50, 52. The component heights 48, 50, 52 are substantially equal to the heights of their respective pockets 34, 36, 38 in which they sit, as seen in FIGS. 2 and 3. A cover 54 dimensioned to have its marginal region seat atop the upper edge 22*a* of the base 22, encloses the pockets 28, 30 and 32. Because the heights 34, 36, 38 of respective pockets 28, 30, 32 are substantially equal to the heights 48, 50, 52 of respective components 42, 44, 46 to be placed therein, the cover 54, when secured to base 22, seals the components 42, 44, 46 into their respective pockets 28, 30, 32 and cinches them into place. Screws 62 are received through holes 64 defined in flange 56*a* and 56*b* extending from the opposite sides of the cover 54 to be received in lug holes 68 defined in lugs 66 extending from the base 22, as seen in FIGS. 2 and 3. The present invention may also be used in applications in which pockets 28, 30, 32 are configured and sized to clamp or retain two or more components stacked in tandem instead of being dedicated to a singular component or to receive components stacked horizontally instead of vertically.

Generally planar support legs 24, 26 descend from the base 22 to support the upper housing 20 upon the canopy surface 6. The present invention may also be used for applications in which the luminaire 2 is supported upon the canopy 4 by a frustoconical, or other shaped clamp described in U.S. Pat. 5,662,407, instead of support legs 24, 26.

As seen in FIGS. 2, 3, 4, a stud 58 has lower end 58*a* threadedly engaged into a threaded bore 16 defined in a boss 74. The socket housing 14 is received through the canopy opening 8 and the stud 58 is received through an opening 25 defined in the upper housing's base 22. A socket seat 27 is sized to receive a top portion 76 of socket housing 14 and align the opening 25 and socket housing 14 coaxially.

A bore 29*a* defined in a channel bar 29 has a diameter slightly larger than the diameter of stud 58. The bar 29 has flanges 29*b*, 29*c* which are received upon the top edge 25*a* of the opening 25. The stud 58 is received through the bore 29*a* and a lock washer 21 and nut 60 assembly is received upon the stud 58 and when tightened, cinch canopy 4 between the upper housing 20 and the lower housing 14. A ring gasket 82 located upon the top wall 76 of the socket housing 14 creates a seal between the upper housing 20 and the socket housing 14 when the nut 60 is tightened.

So that one person may assemble the luminaire 2 without assistance, in the preferred embodiment, a rope bracket 70 is secured to the stud 58 with the lock washer 21 and nut 60 assembly. A rope (not shown) is tied to an aperture 80 defined in the rope bracket 70. The lower housing 10 is raised up and the socket housing 14 fits through the opening 8 in the canopy 4, as seen in FIG. 3. The nut 60 and lock washer 21 are then removed from the 10 stud 58 and the stud 58 is received through the bore 29*a* in the bar 29. The canopy 4 is then cinched between the lower housing 10 and the upper housing 20 by tightening the lock washer 21 and nut 60 assembly back upon the stud 58.

The present invention may also be used for applications in which no canopy 4 is sandwiched between upper and lower housings 20, 10. This alternative embodiment contemplates that the upper housing 20 be used for high-bay luminaires, such as auditorium and gymnasium applications, which simply have the lower housing 10 secured to and located below the base 22 of the upper housing 20, with the bottoms 24*a*, 26*a* of support legs 26 in direct contact with the upper surface 14*d* (FIG. 2) of the base 14*b*.

Additional advantages and modifications will readily appear to those skilled in the art. The invention in its broader aspects is therefore not limited to the specific detail, representative apparatus and illustrative example shown and described. This has been a description as the present invention as currently known. However, the invention itself should only be defined by the appended claims, Wherein we claim:

1. A luminaire, comprising:

at least first and second control components having first and second heights, respectively, an upper housing having a base, at least two pockets in said base, said pockets having first and second openings at their respective upper ends and having first and second heights approximating said first and second heights of said control components, respectively, said first and second control components being located in said first and second pockets respectively; and a single cover located proximate said upper ends of said opening and enclosing said first and second pockets to seal said pockets and clamp said first and second components within their respective first and second pockets.

2. The luminaire of claim 1, wherein said first height of said first pocket is different from said second height of said second pocket.

3. The luminaire of claim 1, further comprising:

a lower housing having a downwardly opening lamp socket housing, a base and a lens frame projecting downwardly from said socket housing, said lamp socket housing enclosing a downwardly opening lamp socket and having an upper end projecting upwardly from said lower housing into said upper housing, and a lower open end, and a fastener connecting said upper and lower housings, said fastener being adapted to draw said upper and lower housing toward one another in order to sandwich a canopy therebetween, thereby facilitating the mounting of said luminaire to said canopy when use of said luminaire with said canopy is desired.

4. The luminaire of claim 3, wherein said upper housing further comprises:

at least first and second downwardly directed support legs having lower edges, said lower edges cooperating with the upper surface of said lower housing base to sandwich said canopy therebetween.

5. The luminaire of claim 4, wherein said first and second downwardly directed support legs are located below said first and second pockets, respectively, said first and second support legs having respectively first and second different heights such that the combined first heights of said first pocket and first leg approximates the combined second heights of said second pocket and second support leg.

6. The luminaire of claim 5 wherein said socket housing is positioned between said legs when said fastener is adjusted to draw the upper and lower housings together.

7. A canopy luminaire adapted to be secured adjacent to a horizontally disposed canopy having an opening therein, the luminaire comprising:

a lower section adapted to underlie the canopy and including a lens having an integral sidewall connected to a bottom wall and defining an interior space, and an upwardly extending member having an upper end adapted to extend through the canopy opening, a vertically disposed high intensity discharge lamp having a light-emitting portion and a base, the light-emitting portion positioned at least partially within the interior space of said lens, and the lamp base adapted to be located at least partially above and generally aligned with the canopy opening, a socket adapted to be located at least partially above the canopy opening and electrically connected to the lamp base, an upper section with an opening therein generally alignable with the canopy opening, the upper end of said upwardly extending member extending through the opening in said upper section, and a securing component interconnecting said upper section and the upper end of said upwardly extending member to secure said upper and lower sections in sandwiching relation to said canopy when said canopy is located therebetween.

8. The canopy luminaire of claim 7, wherein said upper section further comprises a housing, and further including:

electrical control gear connected to the socket, said control gear being located within said housing and spaced above said canopy and said light-emitting portion of said lamp when said luminaire is connected in sandwiching relation to said canopy thereby reducing transfer of heat from said lamp to said electrical control gear.

9. The canopy luminaire of claim 8, wherein said housing includes a bottom wall and a leg extending downwardly from said bottom wall to substantially space the bottom wall above the level of said canopy opening, whereby said control gear is located a substantial distance above the interior space of said lens when the upper and lower sections are disposed in sandwiching relation to the canopy.

10. The canopy luminaire of claim 9, wherein the control gear is spaced laterally from said socket to reduce heat transfer from the light-emitting portion of the lamp to the control gear.

11. The canopy luminaire of claim 8, wherein the housing includes an upper perimeter defining an access opening therein, and further comprising a removable cover adapted to seal along said upper perimeter of said housing to thereby seal said access opening.

12. The canopy luminaire of claim 7, wherein said upwardly extending member is a single extension portion of said lower section and further comprising a seal disposed between the upper end of said extension portion and said upper section.

13. A canopy luminaire comprising:

a lower lamp housing including a lens configured to receive the light-emitting section of a lamp and further including an integral narrow neck extending therefrom with an outer end, a lamp socket disposed within said integral narrow neck and opening downwardly toward said lamp housing and sized to receive a base of said lamp, said socket having an electrical contact and being electrically connectable to the base of said lamp when said lamp base is inserted therein, and an upper ballast housing mounted adjacent said narrow neck and having a ballast electrically connected to said lamp socket.

14. A method of installing a canopy luminaire on a horizontal canopy panel, said luminaire including having a housing with a translucent lens. and a lamp socket with an electrical connection, the method comprising:

inserting a connecting portion of the housing through an opening in said horizontal canopy panel from below said horizontal canopy panel;

fixedly securing said housing adjacent to said panel from above said panel after said inserting step; and coupling the electrical connection to a power source.

15. A method of installing a canopy luminaire on a horizontal canopy panel, said luminaire including a lower housing adapted to receive a light emitting portion of a lamp and an upper housing containing electrical control gear for said lamp, the method comprising:

positioning the upper and lower housings in sandwiching relation relative to said horizontal canopy panel;

fastening said upper and lower housings together with at least one fastening element; and using at least one sealing element to prevent water from leaking into said lower housing from above said horizontal canopy panel.

* * * * *

UNITED STATES PATENT AND TRADEMARK OFFICE

CERTIFICATE OF CORRECTION

PATENT NO. : 6,497,499 B1
DATED : December 24, 2002
INVENTOR(S) : Fischer et al.

It is certified that error appears in the above-identified patent and that said Letters Patent is hereby corrected as shown below:

Title page,
Item [56], OTHER PUBLICATIONS, reads “lithonia” and should read -- Lithonia --.

Column 3,
Line 25, reads “heights 5 34, 36, 38” and should read -- heights 34, 36, 38 --.

Column 4,
Line 13, reads “removed from the 10 stud 58” and should read
-- removed from the stud 58 --.

Signed and Sealed this

Sixteenth Day of September, 2003

JAMES E. ROGAN
*Director of the United States Patent and Trademark Office*